US008640892B2

(12) United States Patent
Polizzi et al.

(10) Patent No.: US 8,640,892 B2
(45) Date of Patent: Feb. 4, 2014

(54) PIVOTING SHELF ASSEMBLY

(71) Applicants: Joseph A. Polizzi, Fairport, NY (US); Michael T. Kane, Fairport, NY (US)

(72) Inventors: Joseph A. Polizzi, Fairport, NY (US); Michael T. Kane, Fairport, NY (US)

( * ) Notice: Subject to any disclaimer, the term of this patent is extended or adjusted under 35 U.S.C. 154(b) by 0 days.

(21) Appl. No.: 13/952,662

(22) Filed: Jul. 28, 2013

(65) Prior Publication Data

US 2013/0307391 A1 Nov. 21, 2013

Related U.S. Application Data

(62) Division of application No. 12/684,740, filed on Jan. 8, 2010, now Pat. No. 8,517,190.

(60) Provisional application No. 61/149,064, filed on Feb. 2, 2009.

(51) Int. Cl.
*A47F 5/08* (2006.01)

(52) U.S. Cl.
USPC ..... 211/150; 211/90.02; 108/65; 108/103; 312/317.3; 312/322

(58) Field of Classification Search
USPC ..... 211/150, 90.02, 168; 312/317.3, 322, 312/323, 325, 329, 408; 108/26, 65–67, 90, 108/103, 108, 140
See application file for complete search history.

(56) References Cited

U.S. PATENT DOCUMENTS

| | | | | |
|---|---|---|---|---|
| 1,494,112 | A * | 5/1924 | Hilger | 62/250 |
| 1,899,171 | A | 2/1933 | Warren | |
| 1,899,372 | A | 2/1933 | Walter | |
| 2,035,226 | A | 3/1936 | Forsthoefel | |
| 2,692,813 | A | 10/1954 | Toronto | |
| 2,795,474 | A | 6/1957 | Carbary | |
| 2,813,635 | A | 11/1957 | Schumacher | |
| 3,172,715 | A * | 3/1965 | Powder | 312/298 |
| 5,056,332 | A | 10/1991 | Tajima | |
| 5,536,081 | A | 7/1996 | Pokhis | |
| 5,577,823 | A | 11/1996 | Maglinger | |
| 5,810,462 | A | 9/1998 | Lee | |
| 6,164,216 | A | 12/2000 | Collier | |
| 2006/0175273 | A1 | 8/2006 | Toomey-Rossow | |
| 2006/0208498 | A1 | 9/2006 | Smyers | |

OTHER PUBLICATIONS

PCT/US2010/020561, International Search Report, Aug. 19, 2010.
PCT/US2010/020561, Written Opinion of the International Preliminary Examining Authority, Nov. 29, 2010.

* cited by examiner

*Primary Examiner* — Korie H Chan
(74) *Attorney, Agent, or Firm* — Tracy Jong Law Firm; Tracy P. Jong; Louis Reale

(57) ABSTRACT

A pivoting storage apparatus that is adapted to storage structures such as cabinets, refrigerators, and the like, whose horizontal interior storage surfaces are generally rectangular. The shelving system is presented in the form of a shelf accessory, in addition to use as an independent storage platform. A portion of the rotary shelving is capable of being manually drawn out of the confines of the storage structure's interior by the user, thereby enabling easy access to shelf contents.

8 Claims, 13 Drawing Sheets

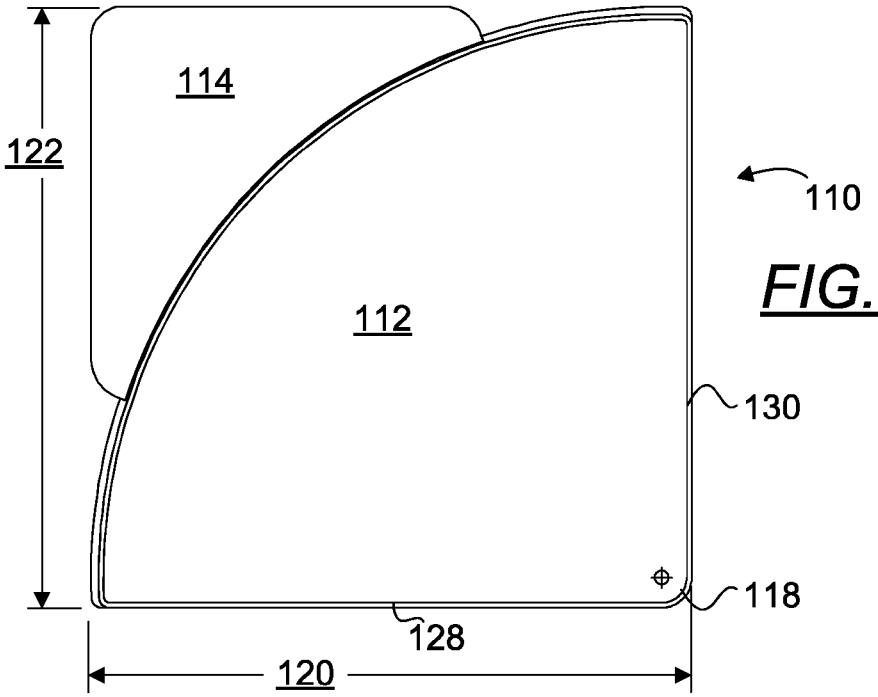
FIG. 1B
FIG. 1C
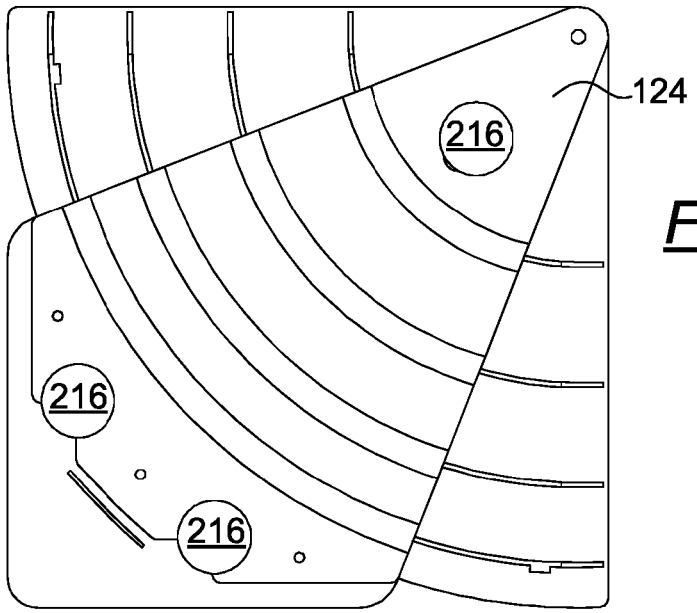
FIG. 1D

FIG. 4A
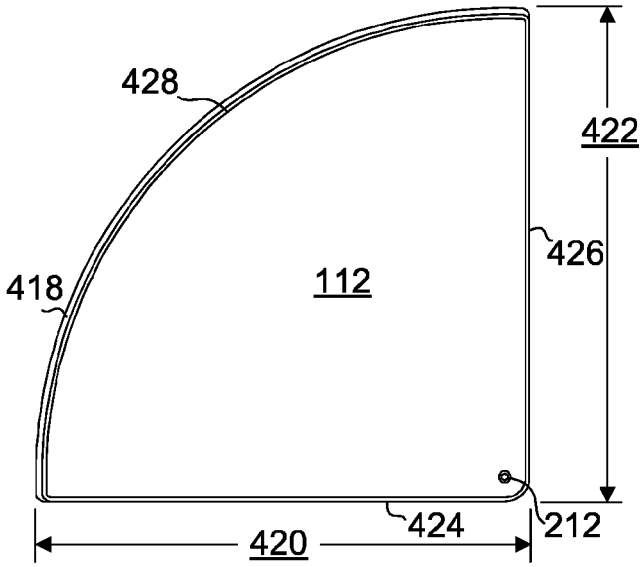
FIG. 4B
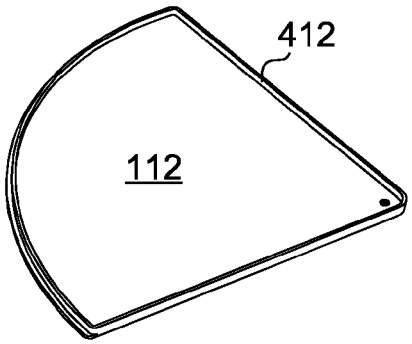
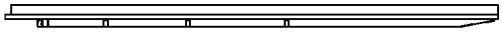
FIG. 4C
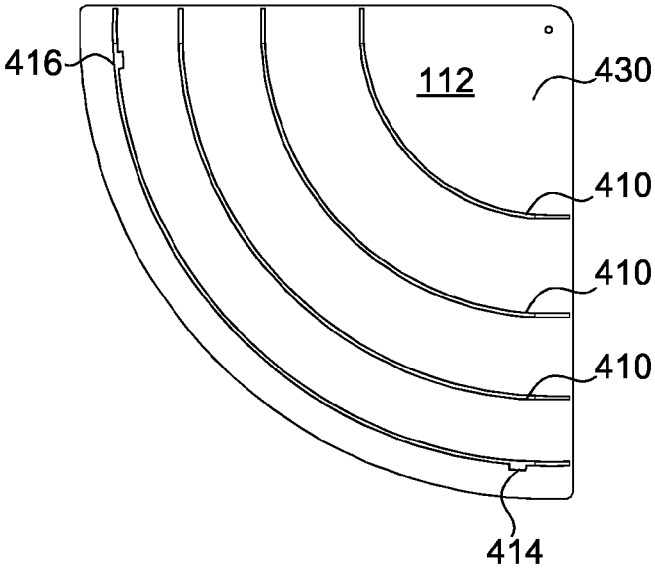
FIG. 4D

FIG. 5A
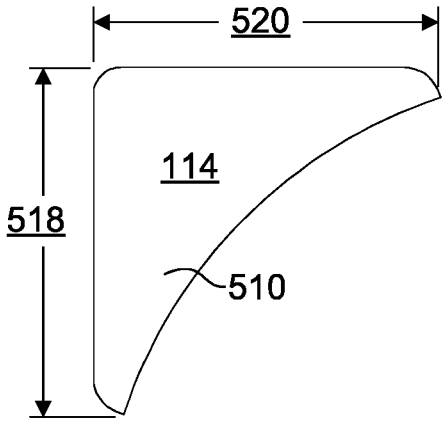
FIG. 5B
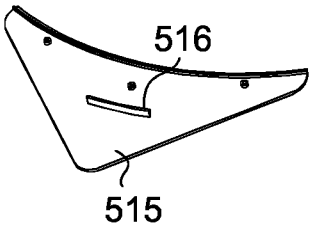
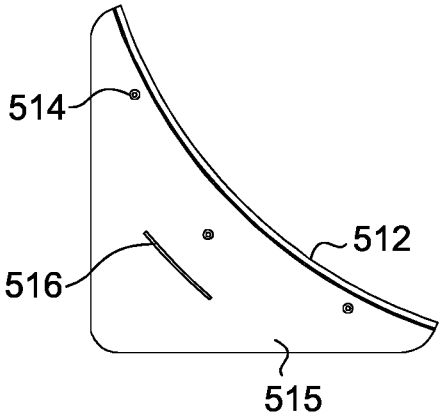
FIG. 5C

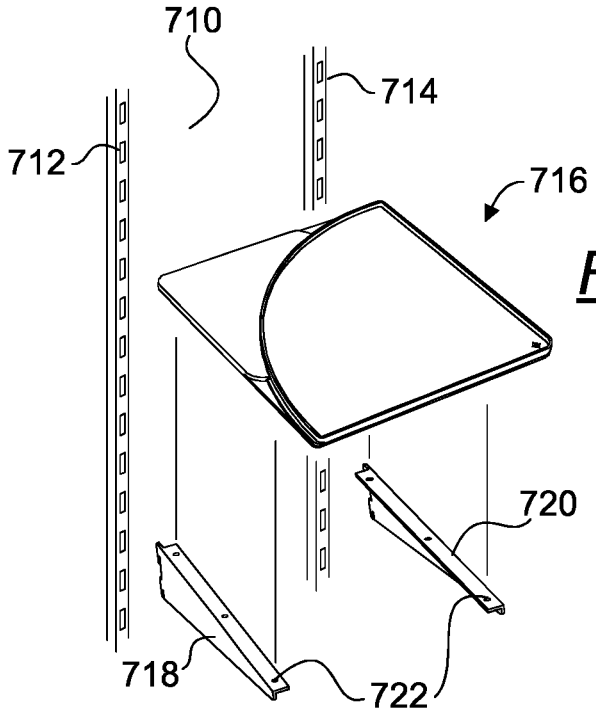
FIG. 7A
FIG. 7B
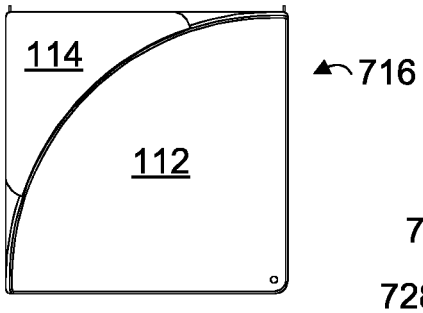
FIG. 7C
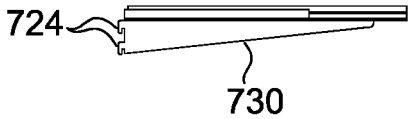
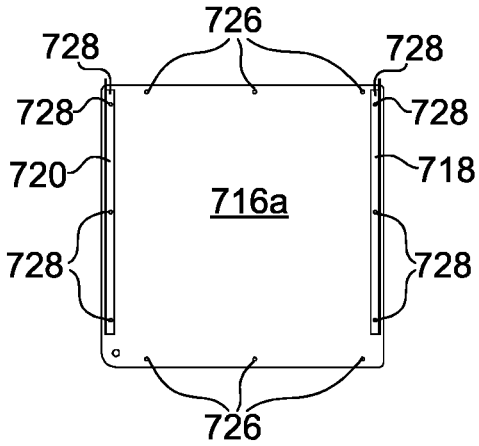
FIG. 7D

FIG. 9B
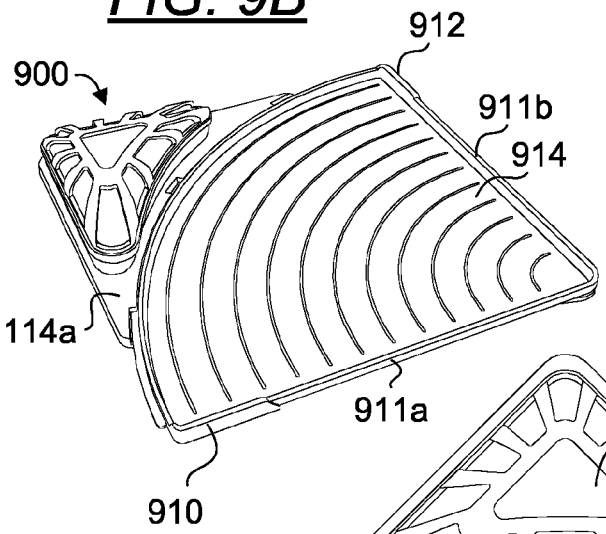
FIG. 9A
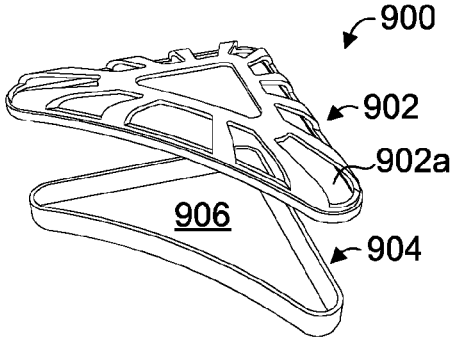
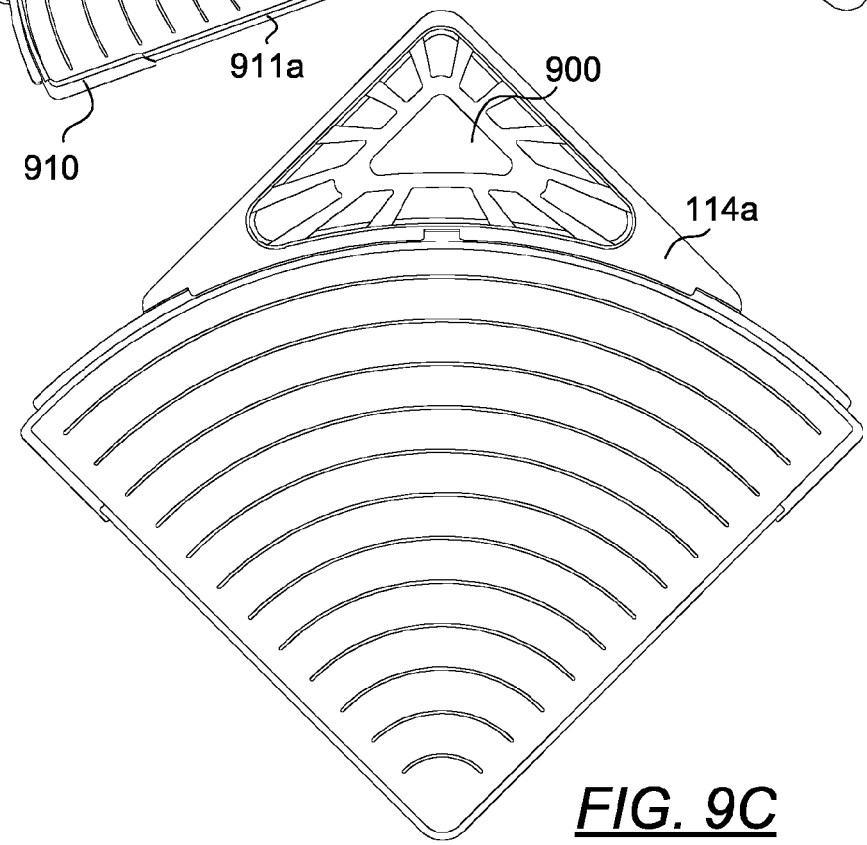
FIG. 9C

PIVOTING SHELF ASSEMBLY

RELATED APPLICATIONS AND PRIORITY CLAIM

This divisional application claims priority to U.S. Ser. No. 61/149,064 a provisional application filed Feb. 2, 2009, U.S. Ser. No. 12/684,740 a non-provisional application filed Jan. 8, 2010. Each of these applications is incorporated by reference herein in its entirety.

FIELD OF THE INVENTION

The present invention relates generally to pivoting or rotary shelving systems, and more specifically, to a pivoting storage apparatus that is adapted to refrigerators or any other structure possessing horizontal generally rectangular storage surfaces. A portion of pivoting storage apparatus is able to be manually drawn out of the confines of the storage structure's interior by a user, thereby enabling easy access to shelf contents thereon.

BACKGROUND OF THE INVENTION

Even though the use and advantages of various rotary or pivoting storage devices applied to storage structures are known, there remain voids regarding desirable attributes pertaining to such rotary or pivoting storage devices, their methods of use, as well as solving and/or overcoming the underlining motives that prompts their use.

The following are related art examples of rotary or pivoting shelving systems for use in storage structures such as cabinets, refrigerators, and the like. For example, U.S. Pat. No. 3,172,715 to Powder and U.S. Pat. No. 2,692,813 to Toronto disclose shelving systems that require a pivoting joint assembly capable of bearing essentially the full load of the mobile shelf and its contents. Such systems require complex, heavy-duty, space consuming, hardware. In addition, the refrigerator side walls must be capable or configured to accept such mounting hardware as well as possessing the strength to tolerate such loads.

Both U.S. Pat. No. 5,810,462 to Lee and U.S. Pat. No. 1,899,171 to Warren describe shelving systems that call for several regions of attachment or points of support, including a refrigerator side wall, back wall, and a required support joint type connection affixed to the refrigerator's front door. The required connection to the front door mandates that the load burden of the mobile shelf and its contents are manipulated by a user during every door opening episode. Furthermore, the entire contents residing on the shelf are removed from the climate controlled interior of the refrigerator to the outside environment during each door open/close cycle, compounding the opportunity for thermal loss, food spoilage, and the like.

U.S. Pat. No. 5,577,823 to Maglinger discloses a shelving system that utilizes a pull-out drawer member incorporating a full round rotating storage container having a bottom with attached side walls. The container's circular shape results in a loss of available storage area in comparison to the available rectangular storage footprint where such a unit would typically reside. In addition, due to the absence of a home position (commonly lacking in full round rotating storage units), the relative arrangement of stored objects is not maintained from one visit to the next. Additionally, the apparatus creates an awkward accessibility scenario where the drawer unit must be maneuvered to the extreme forward extended position before complete accessibility to container contents, via a top opening, is possible.

The purpose of the present invention is to overcome several shortcomings in the aforementioned prior art as well as the introduction of additional novel features.

SUMMARY OF THE INVENTION

The present invention is directed toward a pivoting storage apparatus, and more specifically, to a pivoting storage apparatus that is adapted to storage structures of generally rectilinear geometry having generally rectangular interior storage surfaces, such as cabinets, refrigerators, and the like. The basic system is comprised of a pivoting main tray connected to the top of a flat base that is attached to a substantially fixed feature comprising a storage structure (e.g. a shelf, side walls, a back wall). The main tray component of the pivoting storage apparatus is capable of being manually drawn out of the confines of the structure's interior by a user, thereby enabling easy access to shelf contents thereon.

The basic method of retrieving object(s) resting on the pivoting storage apparatus comprises the steps of opening the door(s) of the storage structure, extending the main tray forward from its home position, locating and retrieving the object(s) of interest, closing or returning the main tray to its home position, and closing the storage structure's door(s).

Accordingly, a primary object of the present invention is to provide a quadrant shaped, pie shaped, or a sector shaped pivoting storage shelf assembly, configured for quick simple attachment to an existing surface, such as a shelf; as well as the ability to be affixed to standard mounting structures such as slots, slotted track, and the like, typically found in refrigerators, cabinets, and the like.

Another object of the present invention is to maximize the efficient use of storage space pertaining to the commonly utilized rectangular storage footprint.

Yet another object of the present invention is to maintain the relative location of stored objects with respect to each other and with respect to the storage structure environment. The preservation of object placement operates in conjunction with the pivoting storage feature of the present invention providing easy access to stored contents as well as an unchanging storage surface to promote easy item location via memory recall.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claim(s) appended to this specification.

In this respect, before explaining at least one embodiment of the invention in detail, it is to be understood that the invention is not limited to the details of construction and the arrangements of the components set forth in the following description or illustrated in the drawings. The present invention is capable of other embodiments and of being practiced and carried out in various ways.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent construction insofar as they do not depart from the spirit and scope of the conception regarded as the present invention.

PARTICULAR ADVANTAGES OF THE INVENTION

The present invention provides several advantages, including simple attachment to storage surfaces, such as racks, shelving, and the like located in refrigerators, cabinets and the like. The storage surface can be of the solid type (e.g. continuous sheet of glass or plastic), or the open area variety (e.g. wire rack, perforated metal or plastic). Additionally, the present invention of configured to make efficient use of the commonly found rectangular storage footprint typically found in storage structures. The unique pivoting feature in combination with a corner tray outperforms simple full round rotating storage units. Such full round rotating storage units (i.e. revolving servers or Lazy Susans) are plagued with undesirable attributes such as inherent storage losses, central dead spot issues, and the loss of relative arrangement of stored objects.

BRIEF DESCRIPTION OF THE DRAWINGS

The invention will be described by reference to the specification and the drawings, in which like numerals refer to like elements, and wherein:

FIG. 1B shows an orthogonal top view of a pivoting storage apparatus in accordance with the embodiment of FIG. 1A FIG. 1C shows an orthogonal side view of a pivoting storage apparatus in accordance with the embodiment of FIG. 1A.

FIG. 1D shows an orthogonal bottom view of the pivoting storage apparatus in accordance with the embodiment of FIG. 1A.

FIG. 4A shows an orthogonal top view of a main tray of a pivoting storage apparatus in accordance with one embodiment.

FIG. 4B shows a perspective top view of a main tray of a pivoting storage apparatus in accordance with one embodiment.

FIG. 4C shows an orthogonal side view of a main tray of a pivoting storage apparatus in accordance with one embodiment.

FIG. 4D shows an orthogonal bottom view of a main tray of a pivoting storage apparatus in accordance with one embodiment.

FIG. 5A shows an orthogonal top view of a corner tray of a pivoting storage apparatus in accordance with one embodiment.

FIG. 5B shows a perspective bottom view of a corner tray of a pivoting storage apparatus in accordance with one embodiment.

FIG. 5C shows an orthogonal bottom view of a corner tray of a pivoting storage apparatus in accordance with one embodiment.

FIG. 7A shows a perspective top view of a pivoting storage apparatus in accordance with an alternate embodiment having two support arms configured to mount to a pair of vertical rails having periodic mounting slots.

FIG. 7B shows an orthogonal top view of a pivoting storage apparatus in accordance with the alternate embodiment of FIG. 7A.

FIG. 7C shows an orthogonal side view of a support arm used in accordance with the alternate embodiment of FIG. 7A.

FIG. 7D shows an orthogonal bottom view of a pivoting storage apparatus in accordance with the alternate embodiment of FIG. 7A.

FIG. 9A shows a perspective top view of a standalone corner tray container.

FIG. 9B shows a perspective top view of a standalone corner tray container resting on the corner tray portion of one embodiment of a pivoting storage apparatus.

FIG. 9C shows an orthogonal top view of a standalone corner tray container resting on the corner tray portion of one embodiment of a pivoting storage apparatus.

Figure 1A:
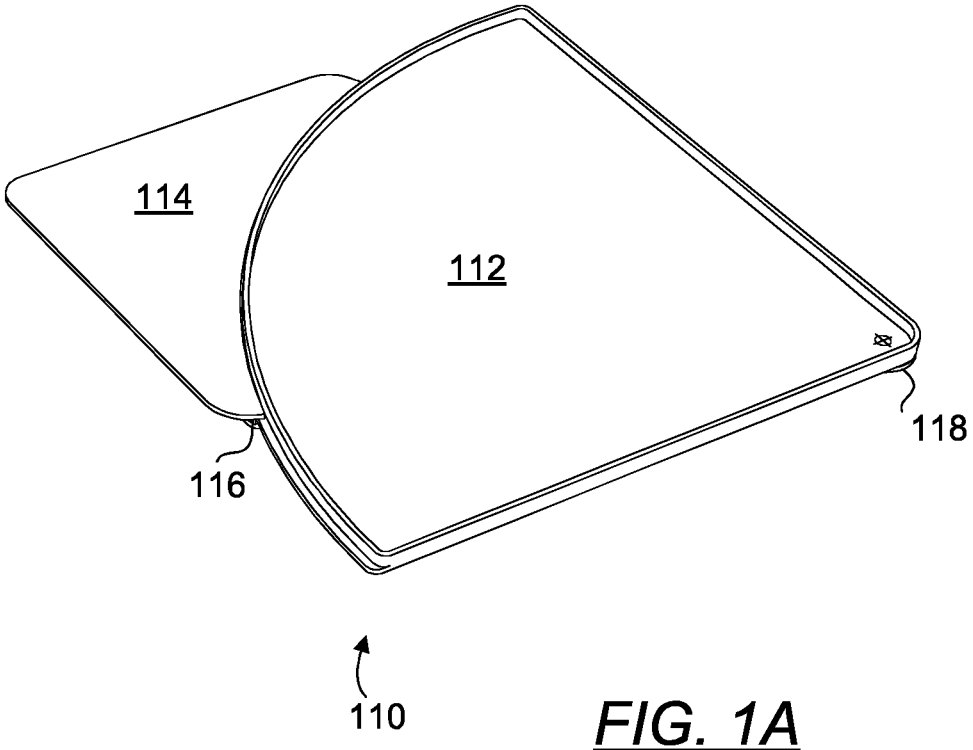
FIG. 1A shows a perspective top view of a pivoting storage apparatus in accordance with one embodiment having an attached corner tray.

The drawings are not to scale, in fact, some aspects have been emphasized for a better illustration and understanding of the written description.

PARTS LIST FOR PIVOTING STORAGE APPARATUS

110. Pivoting storage apparatus
112. Main Tray
114. Corner Tray
114*a*. Integrated corner tray
116. Mating Interface
118. Corner Based Pivot Point
120. Assembly First Side Dimension
122. Assembly Second Side Dimension

124. Bottom Surface (Base)
126. Slide Edge Cavity
128. First Edge (Main Tray)
130. Second Edge (Main Tray)
210. Main Tray Pivot Fastener Receiver
212. Main Tray pivot Aperture
214. Base Pivot Fastener
216. Resting Surface Fasteners (Suction Cups)
218. Base Corner Tray Fasteners
310. Base
311. Base retaining lip
310*a*. Alternate base
312. Locking receptacles
312*a*. Fastening receptacles
312*b*. Detail of fastening receptacles
313. Base pivoting corner
314. Base-Corner Tray Apertures
315. Alternate fasteners
315*a*. Tie wrap
315*b*. Twist tie
315*c*. Nut, bolt, and washer
316. Base pivot aperture
316*a*. Integrated base pivot aperture lip
316*b*. Integrated main tray tabs
318. Base Width
320. Base Length
322. First Stop Post
324. Second Stop Post
326. Channel
328. Top Surface
330. Elevated Surface
410. Main Tray Ribs
412. Vertical Wall
413. Main tray pivoting corner
414. First Stop Tab
416. Second Stop Tab
418. Slide Edge
420. Main Tray First Edge Dimension
422. Main Tray Second Edge Dimension
424. Main Tray First Edge
426. Main Tray Second Edge
428. Arciformed Edge
430. Bottom Surface
510. Corner Tray Top Surface
512. Retaining Lip
514. Base Fastener Receptacles
515. Corner Tray Bottom Surface
516. Positioning Member
518. Corner Tray First Side
520. Corner Tray Second Side
610. Resting Surface
612. Support Member
614. Storage Structure
616. Clockwise Mounting
618. Counterclockwise Mounting
620. Clockwise Arc Trajectory
622. Counterclockwise Arc Trajectory
624. Left Door
626. Right Door
628. Left Side Wall
630. Right Side Wall
632. Back Wall
634. Open Position
710. Back Wall
712. Left Slotted Track
714. Right Slotted Track
716. Pivoting Storage Apparatus (with Support Brackets)
716*a*. Bottom of Pivoting Storage Apparatus
718. Left Support Bracket
720. Right Support Bracket
722. Bracket Mounting Holes
724. Mounting Tabs
726. Clockwise Mounting Holes
728. Counterclockwise Mounting Holes
730. Support Bracket
810. Right Side Wall
812. Left Side Wall
814. Interior
816. Storage Structure
818. Back Wall
820. Left Slot
822. Right Slot
824. Pivoting storage apparatus (with Side Rails)
826. Left Rail
828. Right Rail
830. Rectangular Base
832. Bottom (of Base)
900. Corner tray container
902. Corner tray container cover
902*a*. Corner tray container cover aperture
904. Corner tray container bottom
906. Container bottom
910. First main tray handle
911*a*. First main tray edge
911*b*. Second main tray edge
912. Second main tray handle
914. Main tray It is to be understood that the phraseology and terminology employed herein are for the purpose of description and should not be regarded as limiting.

Definitions Of Terms Used In This Specification

The pivoting storage apparatus adapted to rectilinear structures aforementioned shall have equivalent nomenclature including: the pivoting storage apparatus, the device, the present invention, or the invention. Also, the term rectangular is understood to include case where all sides of the geometric shape are of equal length, also known as an equilateral rectangle or a square.

As used in the this specification, the term pie-cut, quadrant shape, sector shape, sector-cut, or ninety degree sector shape, shall be defined by the ordinary mathematical meaning of a "sector" defined by the region of a circle formed by two radii and their intercepted arc, where the angle between the two radii, in the present invention, is about 90 degrees. Additionally, the term "exemplary" shall possess only one meaning in this disclosure; wherein the term "exemplary" shall mean: serving as an example, instance, or illustration.

DETAILED DESCRIPTION OF THE INVENTION

Figure 6A:
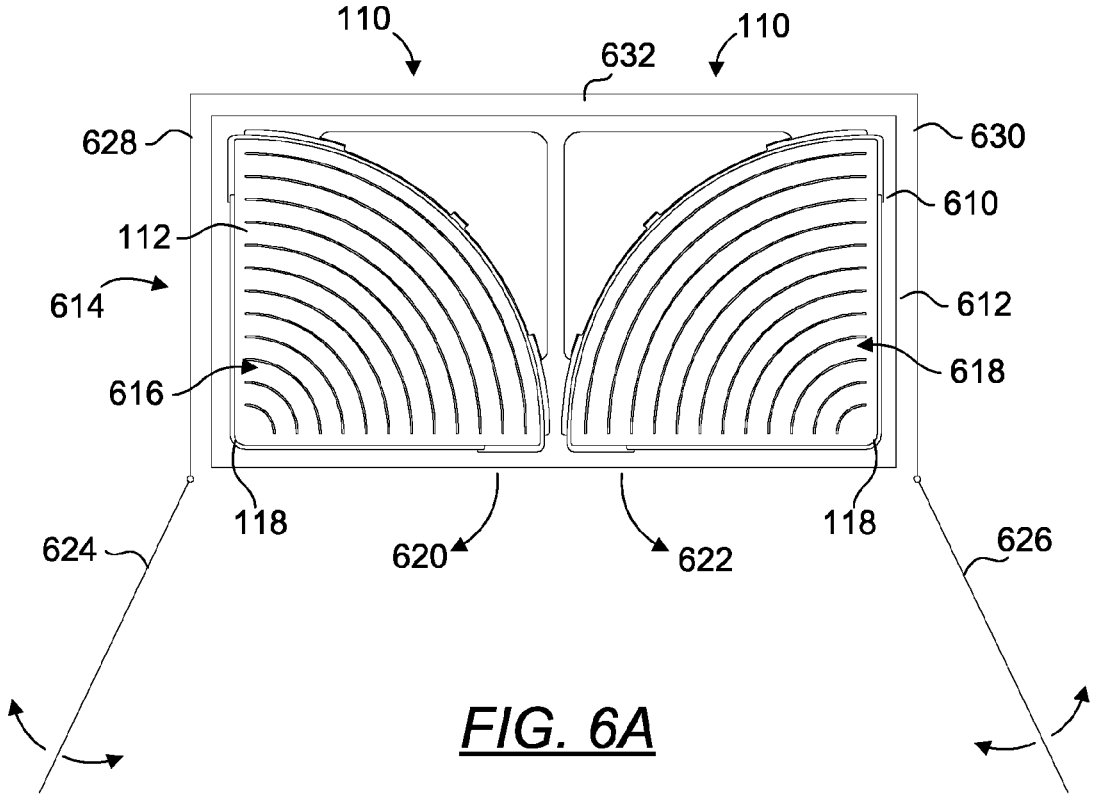
FIG. 6A illustrates an orthogonal top view of two adjacent pivoting storage devices showing clockwise and counterclockwise mounting schemes in a typical storage environment having a generally rectangular geometry and two opposing doors.
Figure 6B:
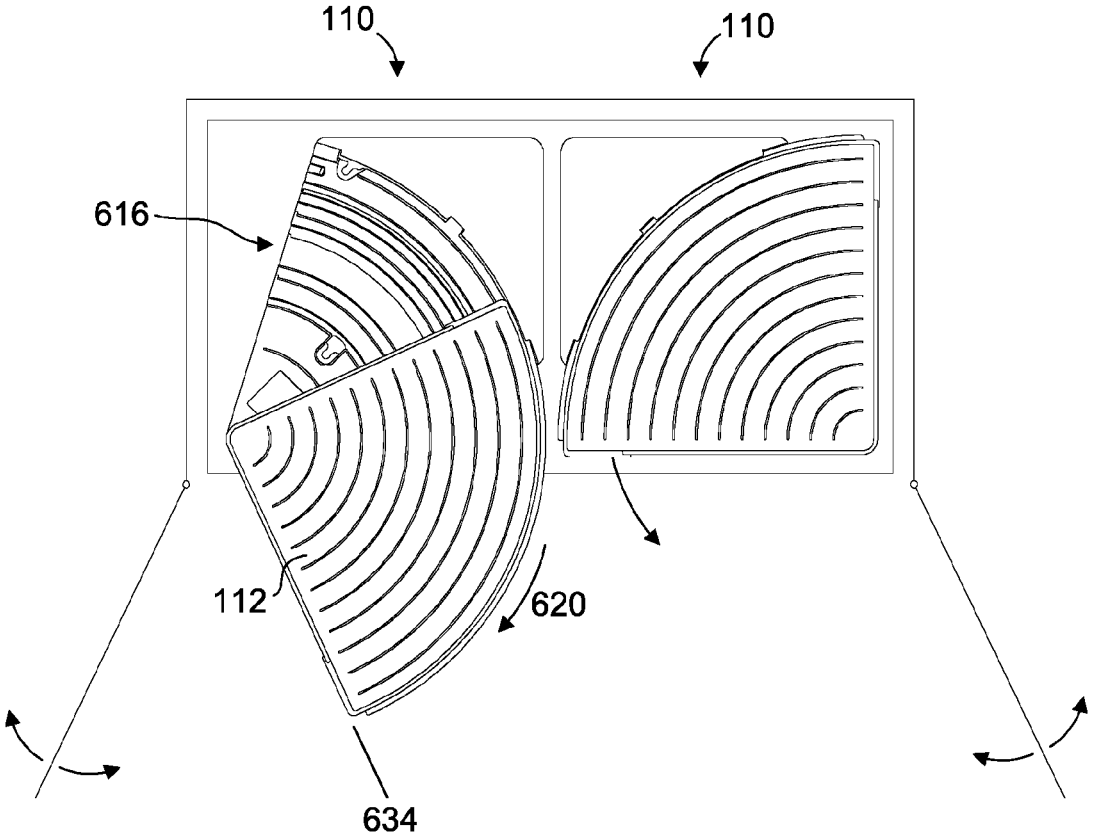
FIG. 6B illustrates an orthogonal top view of two adjacent pivoting storage devices, with the left storage device pivoted in the open position, showing clockwise and counterclockwise mounting schemes in a typical storage environment having a generally rectangular geometry and two opposing doors.

The first embodiment of the pivoting storage apparatus 110 having a separate corner tray 114 is depicted in FIGS. 1A to 1E, FIG. 2, FIGS. 3A and 3B, FIGS. 4A to 4D, FIGS. 5A to 5C. This embodiment is configured to be used as an accessory type device for use in storage structures such as refrigerators, cabinets, and the like, to facilitate object manipulation. The device is intended to function as a removeably attachable storage aid or accessory, and is depicted as an accessory mounted on resting surface 610 of existing support member 612 located in storage structure 614, as depicted in FIGS. 6A and 6B. The existing support member 612 provides a resting surface 610, and includes shelves, racks, ledges, and the like.

Figure 1E:
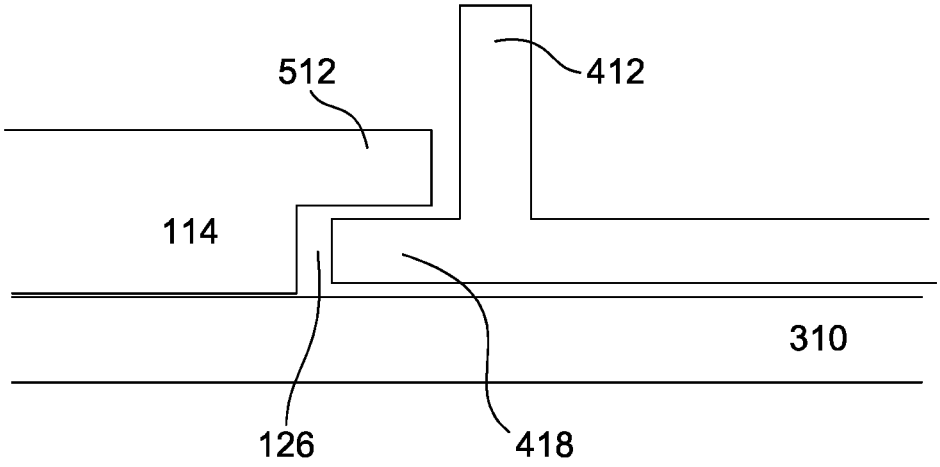
FIG. 1E shows a partial cutaway side view of the pivoting storage apparatus in accordance with the embodiment of FIG. 1A.

FIGS. 1A and 1B depict a perspective top view and an orthogonal top view of the pivoting storage apparatus 110 respectively showing main tray 112 having sliding relationship with corner tray 114 via mating interface 116 (see FIG. 1E for detail) and pivoting corner 118. Referring to FIG. 1E, it is understood that sliding edge cavity 126 with retaining lip 512 are not corner tray 114 required features, alternatively, such features can be incorporated into base 310; in such a system, corner tray 114 becomes an optional component of pivoting storage apparatus 110.

It is well known that the center of rotation or pivot point of a circular planar object, such as a disk, is a location characterized by little to no relative movement as the circular planar object is rotated about the pivot point. Therefore, access to a centrally located object(s) stored on a full round rotating type devices (e.g. Lazy Susans) is not substantially improved by the rotation of such devices. As can be seen in FIGS. 1A and 1B, the present invention's pivot point is not centrally located, but positioned on a corner based pivot point 118 locations. Referring to FIG. 6A, when pivoting storage apparatus 110 is mounted such that corner based pivot points 118 are positioned on the accessible front portion of an existing support member 612, the accessibility dead spots on main tray 112 are essentially eliminated. The accessibility of centrally located objects on a full round rotating unit is not substantially improved by the rotation of the unit due to the center of rotation residing at the geometrical center of the unit; whereas in the present invention, the center of rotation is configured to reside on a front corner of the device when installed, thereby overcoming the inaccessibility issue.

Furthermore, the relative arrangement of stored objects on the present invention is maintained (unlike full round rotating units lacking a home position); this feature may be of particular interest to those who prefer such spatial reproducibility (e.g. visually impaired, elderly, and the like).

Figure 2:
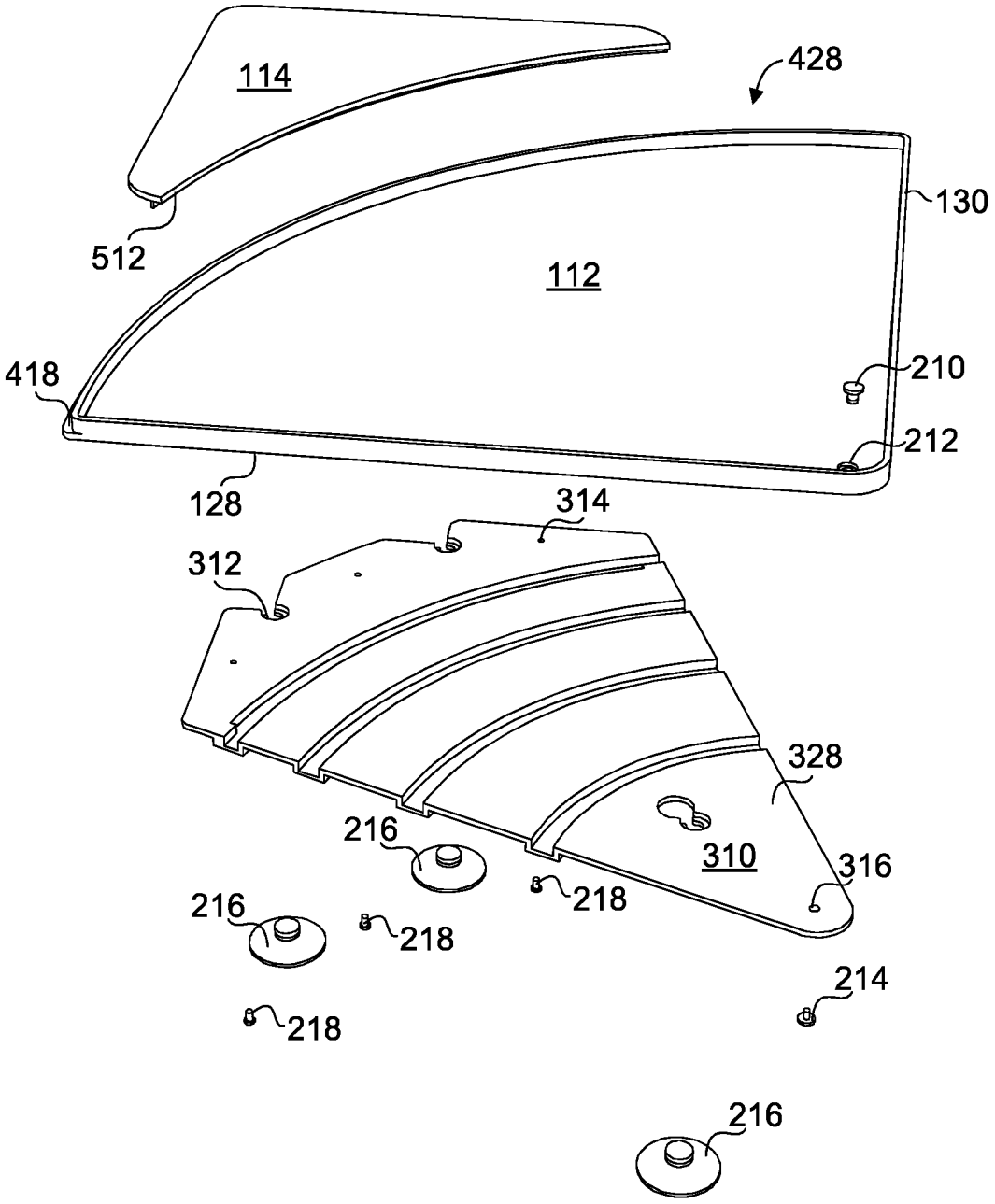
FIG. 2 is an exploded perspective view of the embodiment shown in FIG. 1A depicting additional detail.

FIG. 2 depicts an exploded perspective view of pivoting shelving assembly 110 that is adapted to resting surface 610 of support member 612 (e.g. refrigerator rack, cabinet shelf, and the like) of FIG. 6A. The pivoting shelving assembly 110 includes a base 310, having a generally planar geometry, that contains an array of locking receptacles 312 integrated into base 310, accessible via bottom surface 124 of base 310 (bottom view best depicted in FIG. 1D). Locking receptacles 312 are configured to accommodate resting surface fasteners 216 that are of the suction cup variety and the like. The function of resting surface fasteners 216 of the suction cup variety is to attach the device to typical continuous smooth surfaces such as refrigerator racks, cabinet shelves, fabricated from smooth glass, plastic, or the like. Resting surface fasteners 216 depicted, are in the form of suction cups configured to firmly adhere to smooth flat surfaces commonly used in shelving associated with refrigeration type appliances and the like. Such suction cup type devices are commonly fabricated from pliable polymeric type materials.

Figure 3A:
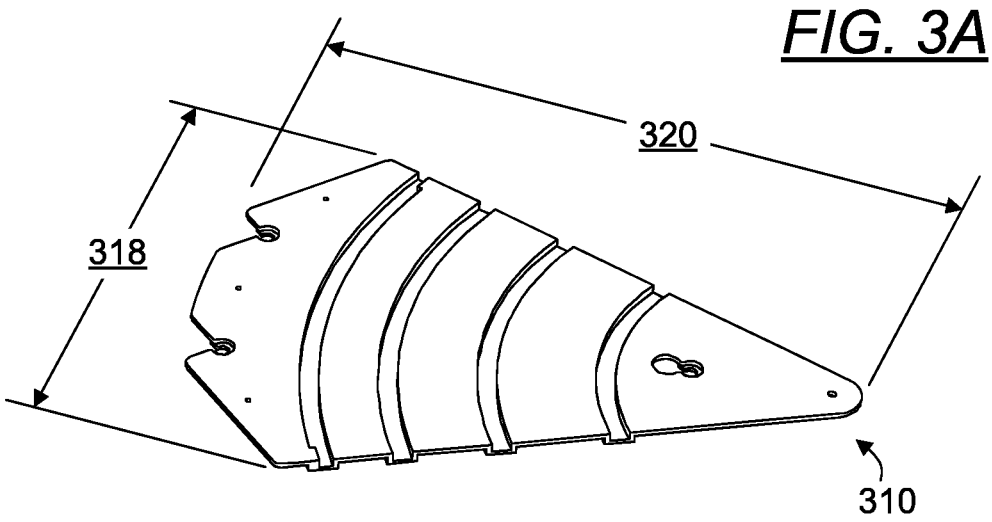
FIG. 3A shows a perspective top view of the base corresponding to the embodiment shown in FIG. 1A.
Figure 3B:
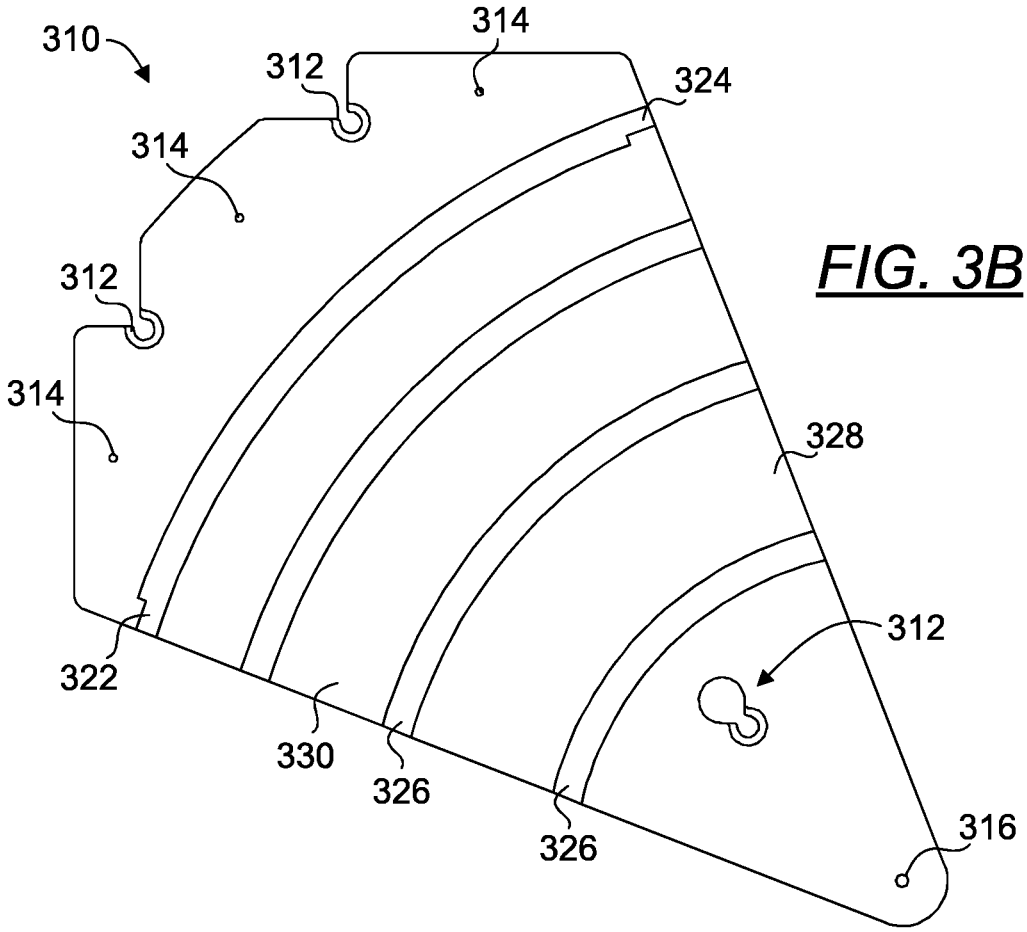
FIG. 3B shows an orthogonal top view of the base corresponding to the embodiment shown in FIG. 1A.
Figures 3C, 3D:
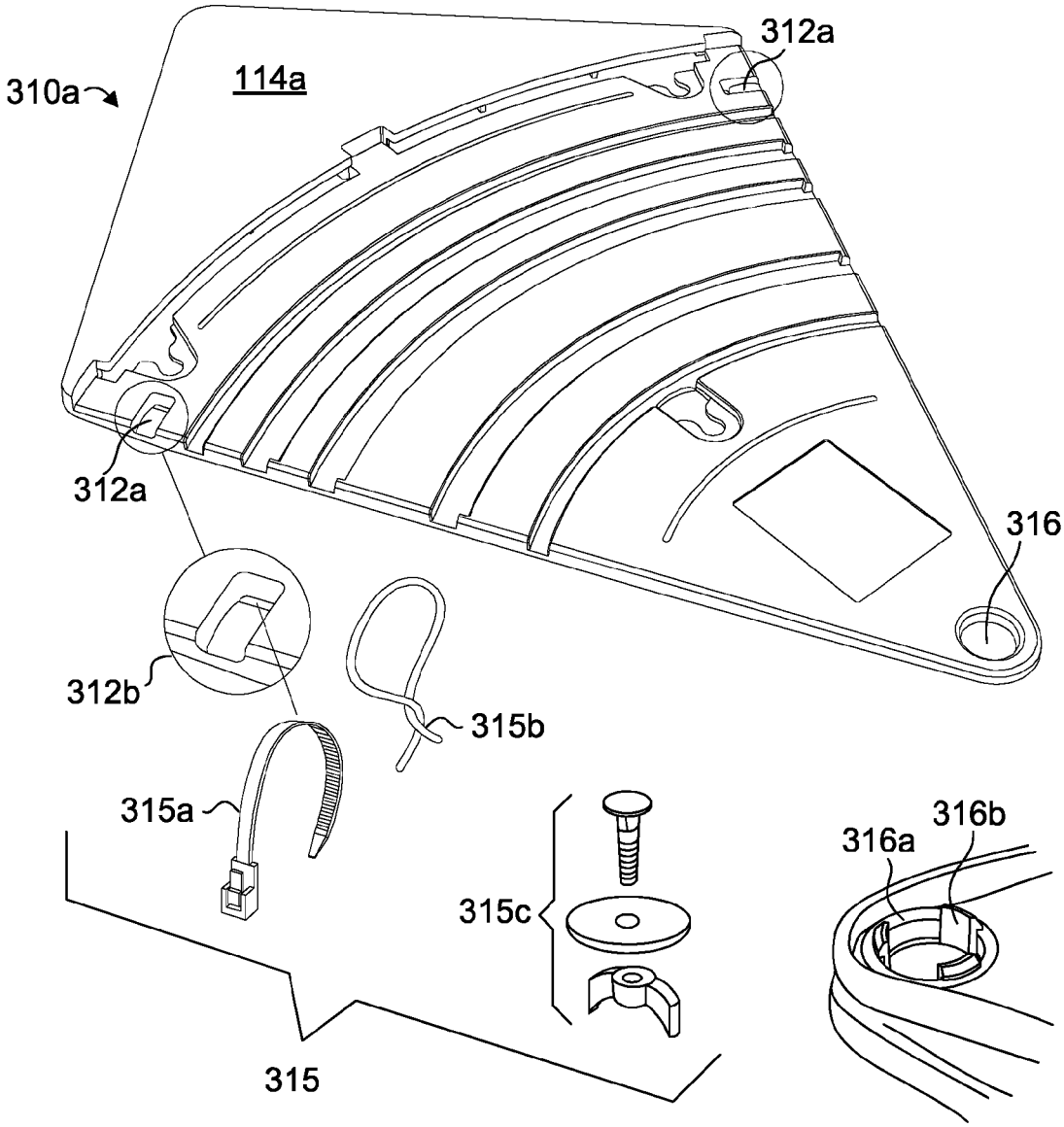
FIG. 3C shows a perspective top view of an alternate embodiment of a base having an integrated corner tray. Also depicted are examples of various means of attaching the base to open type of shelving (e.g. wire rack and the like).
FIG. 3D shows a perspective bottom view of an alternate embodiment of a base to a main tray pivoting system.

Alternate means of attaching the device are depicted in FIG. 3C. Fastening receptacles 312*a* are shown as a generally rectangular aperture in alternate base 310*a*, but are not limited to such geometry. Fastening receptacles 312*a* are adapted to cooperate with alternate fasteners 315 that are configured to cooperate with a support member 612 having a resting surface 610 that possesses large open areas (e.g. wire racks, shelving with perforation type patterns, or the like) where suction cups type fasteners would not properly function. Alternate fasteners 315 include a plurality of tie wraps 315*a*, twist ties 315*b*, nut, bolt, and washer 315*c* assemblies, or any combination thereof. Note that in preferred embodiments, the uses of fasteners that are removeably attachable are preferred so that the pivoting storage apparatus can be removed to facilitate the cleaning of the device as well as the surrounding storage area(s). Therefore, the use of the particular type of tie wraps 315*a*, having a release tab is preferable for the aforementioned reasons as well as to enable the reuse of such fasteners. Aperture geometries other than rectangular, for example circular, are understood to better cooperate with cylindrical type fasteners such as bolts, and are therefore are considered to be a viable option. Additionally, it is understood that other fastener methodologies (e.g. hook and loop, magnetic, and the like) can be used to secure the storage device to a variety of surface types, such fastening means are well known in the fastening arts.

Referring to FIG. 1D, resting surface fasteners 216, depicted in the form of suction cups, are removeably attached to locking receptacles 312 in a positive locking manner, thereby substantially immobilizing the fasteners and securing them to base 310. This is due, in part, to locking receptacles 312 having a figure eight configuration that enables the accommodation of suction cups 216 in a non-permanent manner. The nonpermanent attachment scheme facilitates suction cup replacement as they deteriorate, as well as enabling easy device removal from service.

Again referring to FIG. 2, main tray 112 is pivotally attached to the top surface 328 of base 310 via a base pivot fastener 214 passing through both base pivot aperture 316 and main tray pivot aperture 212, closing the pivoting joint with a main tray fastener receiver 210. Base pivot fastener 214 and main tray fastener receiver 210 combination can be chosen from a variety of well known fastener technologies (e.g. nut and bolt, snap-fit, etc.). It is desirable to utilize a fastener technology that is easily unfastened to enable disassembly of the device to promote clean-up due to spills and the like. FIG. 3D depicts an integrated pivoting system where base pivot aperture lip 316*a* feature is fabricated as an integral part of alternate base 310*a* (shown in FIG. 3C) is configured to pivotally cooperate with integrated main tray tabs 316*b*. Such a pivoting system having integrated components provides a cost effective pivoting means capable of fast and easy assembly as well as disassembly. The integrated pivoting system of FIG. 3*d* reveals one possible pivoting system embodiment where integrated main tray tabs 316*b* are depicted as a plurality of tabs. The plurality of tabs can be configured to snap-fit into place, or provide simple nesting; additionally the plurality of tabs can be replaced with a full circle continuous ring, or the like. It is understood that there exists a myriad of viable equivalent pivoting system embodiments that are capable of satisfactory performance given the pivoting application.

Again referring to FIG. 2, main tray 112 possesses a ninety degree sector shape having a first edge 128 that is perpendicular to a second edge 130, further possessing a third curved or arciformed edge 428, having a slide edge 418. Corner tray 114 is attached to base 310 using base-corner tray fasteners 218 passing through base-corner tray apertures 314 and fastening to base fastener receptacles 514 located on the bottom of corner tray (best depicted in FIG. 5C). Retaining lip 512 of corner tray 114 forms a slide edge cavity 126 (best depicted in FIG. 1E) with base 310 where slide edge 418 of main tray 112 is allowed pivoting movement while simultaneously providing confining support within the geometric plane. It is understood that the retaining lip 512 feature comprising the slidably mating interface (best shown in FIG. 1E), is not limited to the present configuration. In the present configuration, retaining lip 512 is integrated into corner tray 114 as depicted in FIG. 2. The retaining lip 512 feature can alternatively be attached or constitute an integral feature of base 310 as depicted in FIG. 3*c* where base retaining lip 311 is integrated into base 310.

FIGS. 3A and 3B show a perspective top view and an orthogonal top view of base 310, respectively. Base 310 exemplary dimensions for the embodiment shown in FIG. 3*a*, include: base width 318 range from 23.0 cm to 43.0 cm, base length 320 from 42.0 cm to 62.0 cm. FIG. 3B shows additional details of top surface 328 of base 310, including a first stop post 322 and a second stop post 324 which is designed to interface with main tray 112 bottom surface 430 first stop tab 414 and second stop tab 416 respectively (depicted in FIG. 4D); such features provide travel limits that prevent or safeguard main tray 112 from over extension. The present configuration of FIG. 4D shows first stop tab 414 and second stop tab 416 attached to one of a plurality of main tray ribs 410 attached to bottom surface 430 of main tray 112. In the device's fully assembled state, first stop tab 414 and second stop tab 416 are configured to cooperate with mating first stop post 322 and second stop post 324 respectively; where first stop post 322 and second stop post 324 are disposed into at least one predetermined channel 326 located on top surface 328 of base 310. The depiction is intended to be understood as one of many possible arrangements to provide travel limit protection.

The plurality of channels 326 and plurality of elevated surfaces 330 provide base 310 with a corrugated like geometry, such a geometry supplies base 310 structure with additional strength in addition to providing a reduced friction sliding surface. In the situation where the reduction of sliding surface friction is the sole concern (additional base strength is not an issue), there exist additional geometries or features to accomplish the friction reducing task (e.g. bumps, pads, and the like). The reduced friction sliding surface is created by one or more protuberances; these protuberances decrease the surface area between base 310 top surface 328 and interfacing bottom surface 430 of main tray 112. In alternate embodiments, the protuberances can exist solely on base 310 top surface 328 or interfacing bottom surface 430 of main tray 112, or any combination thereof; including the situation where base 310 top surface 328 and interfacing bottom surface 430 of main tray 112 both possess friction reducing protuberances.

Friction reducing protuberances are understood to be constructed from a plurality of elevated features that are not limited to the configurations disclosed. Other possible friction reducing configurations include: rails, posts, periodic high/low surface profiles, random protuberances, and the like. Rail and or channel type protuberances and the like, provide the additional advantage of boosting stiffening properties when applied to base 310 and/or main tray 112 type configurations.

FIG. 3C depicts alternate base 310*a* configuration having an improvement where the alternate embodiment possesses an integrated corner tray 114*a*. In preferred renderings of such an embodiment, integrated corner tray 114*a* and alternate base 310*a* would be fabricated as a single unit in a given manufacturing process (e.g. injection molding).

Base 310*a* depicts two fastening receptacles 312*a* (best depicted in detail of fastening receptacles 312*b*); each receptacle having an aperture that is configured to cooperate with a variety of fasteners that are designed to attach to open area shelving types (e.g. wire rack, perforated metal or plastic). Examples of such fasteners that are designed to attach the present invention to open area type of shelving are depicted as alternate fasteners 315. One such fastener is tie wrap 315*a* that provides a ratchet-like closure; preferred versions of tie wrap 315*a* include those with release tabs that enable the tie to be released and subsequently reused. Another type of fastener is twist tie 315*b*; variations include simple wire, plastic coated metallic wire, and the like. Yet another type of fastener is the common nut, bolt, and washer 315*c*. The basic structures and methods of attachment of the aforementioned attaching schemes are well known.

FIG. 3D depicts alternate base 310*a* configuration having an alternate pivoting scheme where the alternate embodiment incorporates a base pivot aperture 316 having integrated base pivot aperture lip 316*a* configured to pivotally cooperate with a main tray having integrated main tray tabs 316*b*. The disclosed pivoting scheme, and its equivalents, allows the fastening components to be integrated into their respective base and main trap parent members, thereby providing a removeably attachable assembly having fewer individual parts.

FIGS. 4A to 4D show various views and aspects of the main tray 112. Additional details of main tray 112 include a vertical wall 412 best shown in FIG. 4B that provides a means for stiffening main tray 112 as well as furnishing an optionally continuous elevated perimeter to help contain spills and the like. When vertical wall 412 is solely used as a means for stiffening main tray 112, a portion of the main tray perimeter possessing vertical wall 412 may suffice depending upon the device application. Variations of the present configuration include providing a vertical wall 412 for main tray first edge 424, main tray second edge 426, arciformed edge 428, or any combination thereof.

Similar to base 310, the plurality of ribs 410 located on bottom surface 430 of main tray 112 provides main tray 112 with a corrugated like geometry, supplying main tray 112 a structure having additional strength or rigidity in addition to a reduced friction sliding surface. Since main tray 112 is the component that is pivoted forward resulting in a freestanding type condition, providing additional structure that increases strength or rigidity will help main tray 112 maintain a flat, planar profile under loaded conditions. In the situation where the reduction of sliding surface friction is the sole concern (additional base strength is not an issue), there exist additional geometries or features to accomplish the friction reducing task (e.g. bumps, pads, and the like). The reduced friction sliding surface is created by one or more protuberances; these protuberances decrease the surface area between base 310 top surface 328 and interfacing bottom surface 430 of main tray 112. In alternate embodiments, the protuberances can exist solely on base 310 top surface 328 or interfacing bottom surface 430 of main tray 112, or any combination thereof; including the situation where base 310 top surface 328 and interfacing bottom surface 430 of main tray 112 both possess friction reducing protuberances. Friction reducing protuberances are understood to be constructed from a plurality of elevated features that are not limited to the configurations disclosed. Other possible friction reducing configurations include: rails, posts, periodic high/low surface profiles, random protuberances, and the like. Substantially continuous structures such as rails, channels, and the like, type of protuberances provide the additional advantage of increasing strength, more specifically boosting stiffening properties when disposed to base 310 and/or main tray 112 members. Other possible friction reducing configurations include: rails, posts, periodic high/low surface profiles, random protuberances, and the like.

Exemplary main tray 112 dimensions of the embodiment of FIG. 4A include: main tray first edge dimension 420 range from 29.0 cm to 39.0 cm, main tray second edge dimension 422 range from 29.0 cm to 39.0 cm, where the two aforementioned dimensions are substantially equal. Note that assembly first side dimension 120 and assembly second side dimension 122 depicted in FIG. 1B share the same dimensional attributes as main tray first edge dimension 420 and main tray second edge dimension 422 due to the generally square geometry of the device. The generally flat nature of the device is revealed in side view illustration FIG. 4C in addition to side view depicted in FIG. 1C.

FIGS. 5A to 5C show various views and aspects of the corner tray 114. Additional details of corner tray 114 include a positioning member 516 located on corner tray bottom surface 515, shown in FIGS. 5B and 5C. Positioning member 516 provides assistance in properly aligning corner tray 114 to the other device elements during assembly. Exemplary corner tray 114 dimensions of the embodiment depicted in FIG. 5A include: corner tray first side 518 dimension ranges from 15.0 cm to 35.0 cm, corner tray second side 520 dimension ranges from 15.0 cm to 35.0 cm, where the two aforementioned dimensions can differ. Additionally, in order to ensure proper main tray 112 support, it is recommended that the radius of curvature of retaining lip 512 of corner tray 114 be substantially equal to that of arciformed edge 428 of main tray 112 of FIG. 4A to ensure adequate engagement as depicted in FIGS. 1B and 1E.

Referring to FIGS. 6A and 6B, the pivoting storage apparatus 110 has two possible mounting orientations, clockwise mounting 616 corresponding to clockwise arc trajectory 620, and counterclockwise mounting 618 corresponding to counterclockwise arc trajectory 622. The two mounting options 616 and 618 provide a default closing scheme for main tray 112 when the clockwise and counterclockwise arc trajectories correspond with those of left door 624 and right door 626 respectively. The closing of left door 624 and/or right door 626 will help move the corresponding main tray 112 of corresponding devices left in the open position 634, safely return toward its closed (home) position. FIG. 6B depicts the present invention having clockwise mounting 616 with the main tray 112 in open position 634. In order for the device to furnish the two aforementioned mounting orientations depicted in FIG. 6A, (i.e. clockwise mounting 616 with associated clockwise arc trajectory 620, and counterclockwise mounting 618 with associated counterclockwise arc trajectory 622) it is recommended that main tray 112 be substantially modeled after a sector shape, where the term "sector shape" is characterized by the ordinary mathematical meaning of a "sector" that's defined by the region of a circle formed by two radii and their intercepted arc, where the angle between the two radii, in the present invention, is about 90 degrees.

Referring to FIGS. 6A and 6B, both the pivoting storage apparatuses 110 associated with the two mounting orientations, in an alternate embodiment, are either temporarily or permanently attached to each other. Such a pivoting storage configuration will provide the advantages of a seamless or joined construction which include a larger, sturdier device that provides increased storage.

FIGS. 7A to 7D show various views and aspects of another embodiment consisting of a pivoting storage apparatus 716 with support brackets 718, 720 that are adapted for mounting onto a slotted track 712 and 714 respectively. For example, the slotted track 712 and 714 can be mounted onto a back wall 632 of storage structure 614 (shown in FIG. 6A) which can represent cabinets, refrigerators, and the like.

In FIG. 7C, support bracket 730 depicts mounting tabs 724 that removably attach to slotted tracks 712 and 714 of FIG. 7A. Support brackets 718 and 720 of FIG. 7A possess a plurality of bracket mounting holes that align with both clockwise mounting holes 726 and counterclockwise mounting holes 728 located on bottom of pivoting storage apparatus 716*a* shown in FIG. 7D, these holes are situated in two linear type of arrays, parallel to each other, creating two sets of hole pairs. Either a clockwise arc trajectory 620 or a counterclockwise arc trajectory 622 (depicted in FIGS. 6A and 6B) are attainable via selecting the proper hole pair for support bracket 730 mounting. The pivoting storage apparatus 716 is attached to one set of mounting holes (i.e. clockwise mounting holes 726 or counterclockwise mounting holes 726) using an appropriate fastening means (e.g. screws, nuts & bolts, rivets, locking pin hardware, snap-fit, and the like). To preserve the ability to select the aforementioned mounting options, selecting removeably attachable fasteners (e.g. screws, nuts & bolts, etc.) is preferable over fastening means not intended for disassembly (e.g. rivets, adhesives, etc.).

Figure 8A:
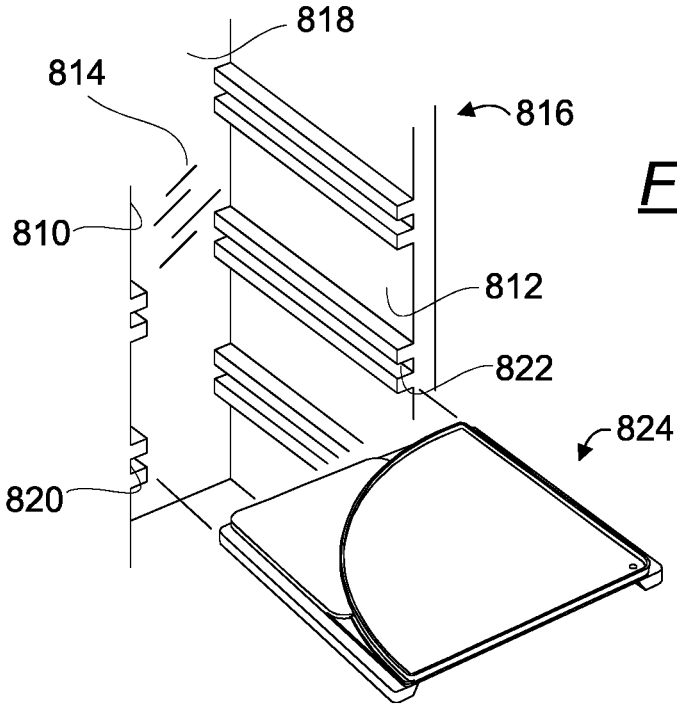
FIG. 8A shows a perspective top view of a pivoting storage apparatus in accordance with an alternate embodiment having a side rail mounting scheme configured to mount into a storage structure having corresponding horizontal slotted rail pairs on each of the two opposing side walls.
Figure 8B:
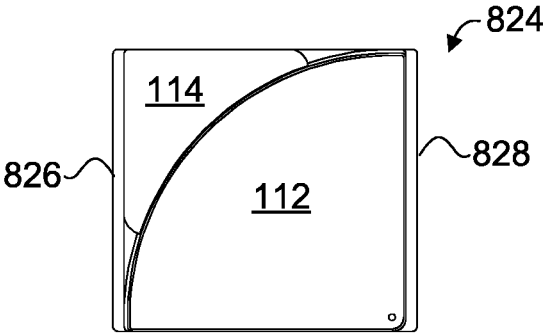
FIG. 8B shows an orthogonal top view of a pivoting storage apparatus in accordance with the alternate embodiment of FIG. 8A.
Figure 8C:
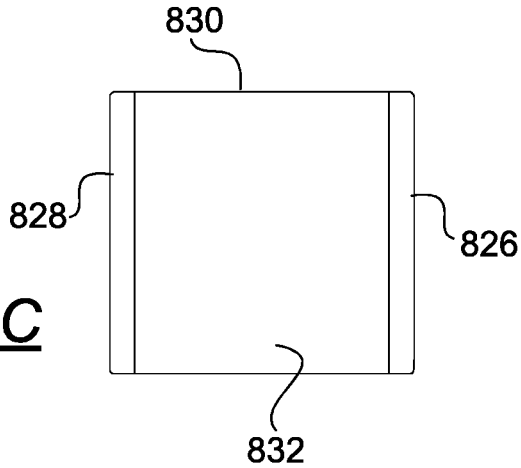
FIG. 8C shows an orthogonal bottom view of a pivoting storage apparatus in accordance with the alternate embodiment of FIG. 8A.

FIGS. 8A to 8C show various views and aspects of another embodiment consisting of a pivoting storage apparatus 824 having a left rail 826 and opposing right rail 828 located on bottom 832 of rectangular base 830, best depicted in FIG. 8C. Pivoting storage apparatus 824 left rail 826 and a right rail 828 are slidingly received by left slot 820 and right slot 822 horizontal supports respectively, or any other horizontal pair of receiving slots, providing height adjustment depicted in FIG. 8A. Left slot 820 and opposing right slot 822 are located on the right side wall 810 and left side wall 812 respectively, of interior 814 of storage structure 816. Back wall 818 furnishes pivoting storage apparatus 824 a natural back stop when inserted into any pair of receiving slots.

The pivoting storage apparatus 824 sliding relationship with a corresponding slot pair provides a user positionable feature giving the user additional access to shelf contents when pivoting storage apparatus 824, as a whole, is pulled forward. When the pivoting storage apparatus 824 is pulled forward, objects stored on the non-pivoting corner tray 114 as well as the objects resting on pivoting corner tray 114 become more accessible to the user; furthermore, accessibility to objects resting on corner tray 114 is further improved when corner tray 114 is situated in open position 634 (as depicted in FIG. 6B) and pivoting storage apparatus 824 is concurrently set to the forward position.

FIG. 9A illustrates a standalone corner tray container 900 having a corner tray container bottom 904, with a container bottom 906 that possesses a generally triangular bottom geometry that is substantially similar in both size and shape to integrated corner tray 114*a* overall general shape, or perimeter geometry, so that corner tray container 900 provides a space efficient means for storage when resting upon integrated corner tray 114*a*, or like corner tray versions. Corner tray container 900 system possesses optional corner tray container cover 902 having a plurality of optional corner tray container cover apertures 902*a*; apertures provide a venting means for deodorizers, baking soda, and the like.

FIG. 9B is a perspective illustration of corner tray container 900 system resting on integrated corner tray 114*a* of the present invention depicting a space efficient means for storage. FIG. 9C is a top view of corner tray container 900 system resting on integrated corner tray 114*a* further depicting a space efficient means for storage.

FIG. 9B further illustrates optional first main tray handle 910 and second main tray handle 912. The function of both main tray handles is to provide a user an easily accessible feature to facilitate the deployment of main tray 914. First main tray handle 910 and second main tray handle 912 are depicted as integrated tabs that are vertical extensions of first main tray edge 911*a* and second main tray edge 911*b*, respectively. The depictions of first main tray handle 910 and second main tray handle 912 are exemplary, and thus are not limited to the depicted embodiment.

Another embodiment of the present invention further includes a main tray utilizing a self-closing feature (not shown) where the main tray, in its open position, upon being released by the user, automatically returns to the home position. The apparatuses for accomplishing such self-closing features are well known and their relatively simple designs enable prompt understanding of the associated mechanical workings. An example of such a mechanism is based on the use of coil springs where energy is stored during the opening of the main tray (by the user) is used to wind the spring and returning the main tray back to its home position is powered by the unwinding spring. Another such example is a gravity based weight system where the opening of the main tray (by the user) is used to elevate a weight and returning the main tray back to its home position is powered by the weight, connected to the main tray (via a cable or the like), being pulled back downward by gravitational forces. Other examples of such self-closing features are based upon compression springs, leaf spring, electric motors, and the like.

The materials that comprise the bulk of the present invention are preferably those of relatively high strength and low weight. In the polymer family, moldable plastics such as Lexan, Nylon, ABS, and the like, can provide relatively high strength and low weight properties in addition to providing high production, low cost advantages. If necessary, additional material's strength can be accomplished through the use of plastic fillers (e.g. glass fiber, and the like); the amount of filler used depends upon the characteristics desired. Exemplary polymers or plastics containing filler include: 30% glass fiber filled nylon, 10% glass fiber filled ABS, or 30% glass fiber filled Lexan (polycarbonate, to name a few. The use of transparent or translucent plastics provides the user with additional benefits including improved illumination and object identification (hindered by opaque materials). From the metals family of materials, aluminum is an example of such a high strength and low weight material, although the use of heavier stainless steel may be preferred in commercial food service type environments.

Composites such as fiberglass are other options that can provide a desired aesthetic look and/or feel in addition to supplying preferred or target combination of engineering properties such as thermal expansion, weight, creep, UV resistance, etc. for specific users and/or environments. The fasteners, brackets, and tracks aforementioned in the present invention with all its embodiments can be fabricated from most any engineering material that can withstand the stresses and wear requirements including polymers, metals and composites, with metals such as surface finished steel, aluminum, and the like, are considered commonplace in such applications.

The invention claimed is:

1. A removeably attachable pivoting shelf assembly adapted for mounting to an interior of a generally rectilinear structure having a right side wall, a left side wall and a back wall, said removeably attachable pivoting shelf assembly comprising:

a base, having a planar, generally rectangular geometry, a top surface, a bottom surface, and a slide edge cavity including a retaining lip, a base pivoting corner, a right side, a left side, and a means for attaching said removeably attachable pivoting shelf assembly to said interior of a generally rectilinear structure; and a main tray, having a planar, generally triangular ninety degree sector geometry, having a top, a bottom, a main tray pivoting corner formed by the jointure of a first edge, a second edge substantially perpendicular to said first edge, and an arciformed edge opposing said main tray pivoting corner, wherein said arciformed edge has a slide edge adapted to interface with said slide edge cavity of said base such that said main tray is supportably retained while permitting sliding motion within said slide edge cavity; and wherein said main tray pivoting corner portion of said main tray is pivotally attached to said base pivoting corner portion of said top surface of said base, forming a corner based pivot point.

2. The removeably attachable pivoting shelf assembly of claim 1, wherein said base further comprises a corner tray extendedly attached, opposite said corner based pivot point, thereby providing an additional storage surface adjacent to said main tray.

3. The removeably attachable pivoting shelf assembly of claim 1, wherein said base further comprises said corner tray that is integrated into said base.

4. The removeably attachable pivoting shelf assembly of claim 1, wherein said main tray further includes a handle disposed about at least one of said first edge, and said second edge of said main tray thereof.

5. The removeably attachable pivoting shelf assembly of claim 1, wherein said bottom surface of said main tray contains at least one protuberance such that the contact surface area interfacing with said top of said base is reduced.

6. The removeably attachable pivoting shelf assembly of claim 1, wherein said means for attaching comprises at least two support brackets attached to said bottom surface of said base, and adapted to be received by a slotted track disposed on said back wall of said interior of said generally rectilinear structure.

7. The removeably attachable pivoting shelf assembly of claim 1, wherein said means for attaching comprises two support rails disposed on both said right and said left sides of said base, and adapted to be received by cooperating horizontal support features disposed on said right and left side walls of said interior of said generally rectilinear structure.

8. The removeably attachable pivoting shelf assembly of claim 1, wherein said corner tray further comprises a corner tray container configured to rest thereon, said corner tray container having a generally triangular cross section that is substantially similar to said corner tray perimeter geometry, thereby providing a space efficient means for storage.

* * * * *